US005575331A

United States Patent [19]

Terrell

[11] Patent Number: 5,575,331

[45] Date of Patent: Nov. 19, 1996

[54] CHEMICAL CUTTER

[75] Inventor: Jamie B. Terrell, Ft. Worth, Tex.

[73] Assignee: Halliburton Company, Houston, Tex.

[21] Appl. No.: 479,949

[22] Filed: Jun. 7, 1995

[51] Int. Cl.[6] ..... E21B 29/02

[52] U.S. Cl. ..... 166/55; 166/55.7; 166/63; 166/212

[58] Field of Search ..... 166/55, 55.7, 63, 166/212, 297, 298

[56] References Cited

U.S. PATENT DOCUMENTS

| | | | |
|---|---|---|---|
| 2,918,125 | 12/1959 | Sweetman | 166/35 |
| 4,125,161 | 11/1978 | Chammas | 166/297 |
| 4,415,029 | 11/1983 | Pratt et al. | 166/212 |
| 4,494,601 | 1/1985 | Pratt et al. | 166/55 |
| 4,619,318 | 10/1986 | Terrell et al. | 166/55 |
| 4,819,728 | 4/1989 | Lafitte | 166/298 |
| 4,949,789 | 8/1990 | Lafitte | 166/298 |
| 4,971,146 | 11/1990 | Terrell | 166/55 |
| 5,287,920 | 2/1994 | Terrell | 166/55 |
| 5,320,174 | 6/1994 | Terrell et al. | 166/297 |
| 5,322,118 | 6/1994 | Terrell | 166/55 |

*Primary Examiner*—Frank Tsay

[57] ABSTRACT

A downhole chemical cutting tool for cutting downhole tubular goods and supporting the tubular goods within the well through a load bearing hub section in the tool. The tool comprises an elongated tool body having a upper head section which is adapted to be connected to a running string such as a string of coiled tubing capable of supporting large loads. The tool body comprises a propellent section and a cutting section. A chemical section is interposed between the propellant section and the cutting section and contains at least one chamber adapted to contain a chemical cutting agent. The cutting section is adapted to receive the chemical cutting agent and has an outer wall section which contains a plurality of transverse cutting ports arranged circumferentially of the cutting section. An anchoring section is provided in the lower portion of the tool body at a location below the cutting section so that suitable means can be attached to the anchoring section to grip the inner surface of the tubular goods below a point at which the cut is to be made. A load bearing hub section in the tool body extends longitudinally through the cutting section to the anchoring section. The hub section functions to connect the anchoring section to the upper portion of the tool body in a load bearing relationship and capable of sustaining a substantial loads in tension. The tool comprises a plurality of longitudinally extending flow passages which are spaced circumferentially about the hub section and extend longitudinally along the hub section. These are in fluid communication with the chemical section so that when the tool is fired a chemical cutting agent can flow from the chemical section through the passageways to the cutting ports. The flow passages are provided with individual accumulations of ignitor material to provide for pre-ignition of chemical cutting agent as it is dispensed from the cutting ports.

28 Claims, 11 Drawing Sheets

CHEMICAL CUTTER

TECHNICAL FIELD

This invention relates to the cutting of downhole tubular goods in well bores, and more particularly to downhole chemical cutting tools for cutting downhole tubular goods which employ a plurality of flow passages circumferentially arranged about a load carrying hub section to permit such tubular goods to be cut and supported within a well bore.

BACKGROUND OF THE INVENTION

There are many circumstances in the oil industry where it is desirable to cut into or through downhole tubular goods within a well. For example, in the course of drilling a well, the drill pipe may become stuck at a downhole location. This may result from "keyseating" or as a result of cuttings which settle within the well around the lower portion of the drill string. In order to remove the drill string from the well, it may be necessary to sever the drill pipe at a location above the stuck point. Similarly, it is often necessary to carry out downhole cutting operatic, as during the completion, operation or abandonment of oil or gas wells. For example, it is sometimes desirable to sever casing or tubing at a downhole location in order to make repairs or withdraw the tubular goods from a well which is being abandoned. In other circumstances, it is desirable to perforate downhole tubular goods. Thus, it is a common expedient to perforate the casing and surrounding cement sheath of a well in order to provide fluid access to a hydrocarbon bearing formation. Similarly, it is sometimes desirable to perforate tubing in the completion or recompletion of a well.

As is well known in the art, chemical cutters can be used to significant advantage in the application of chemicals to cut, sever or perforate downhole tubular goods. For example, U.S. Pat. No. 2,918,125 to Sweetman discloses a downhole chemical cutter which employs cutting fluids that react violently with the object to be cut with the generation of extremely high temperatures sufficient to melt, cut or bum the object. In the Sweetman procedure, halogen fluorides are employed in jet streams impinging on the downhole pipe to sever or perforate the pipe. The attendant reaction is highly exothermic and the pipe is readily penetrated. Examples of chemical cutting agents disclosed in Sweetman are fluorine and the halogen fluorides including such compounds as chlorine trifluoride, chlorine monofluoride, bromine trifluoride, bromine pentafluoride, iodine pentafluoride and iodine heptafluoride. The cutting fluid is expelled from the tool through radial ports formed in the cylindrical wall of the tool in jet cutting streams. In Sweetman, the cutting ports extend radially from a central bore within the discharge head of the cutting tool which terminates in a reduced diameter bore which is open to the lower or front end of the cutting tool. The reduced diameter bore is internally threaded to receive a threaded plug which closes the lower end of the bore. A piston is slidably disposed in the central bore and is equipped with o-rings which bridge the cutting ports when the piston is in the uppermost position. The piston is driven downwardly during the cutting operation. Immediately above the cutting ports is an ignitor section which contains steel wool. The upper portion of the cutting tool is provided with anchoring assembly which functions to anchor the tool in response to an upward pull applied to the cable supporting the tool.

The normal practice in severing downhole tubular goods is to arrange the cutting ports in the cylindrical wall of the cutting head, as disclosed for example in U.S. Pat. No. 4,125,161 to Chammas. Here, the cutting head is a cylindrical member provided with a plurality of cutting ports arranged radially about the outer diameter of the cutting head. The cutting ports are bridged with a piston provided with o-rings to prevent the entry of fluids through the ports. A lower portion of the tool is provided with openings through which well fluid exerts hydrostatic pressure on the bottom of the piston, holding the piston in place before the tool is fired. The Chammas cutting tool incorporates an anchor sub having a plurality of wedges pivoted on an actuating piston near the upper end of the tool in which gas from a propellant charge displaces an actuating piston to cam the wedges outwardly against the tubing string or other object to be cut. The gas from the propellant charge is also employed to force the cutting chemical into contact with a pre-ignitor material and then outwardly through the cutting ports.

Where the downhole tubular goods are to be cut or formed of high strength corrosion resistant materials such as high chrome-nickel stainless steel, a chemical cutter may be employed in which the cutting parts are arranged in complimentary configurations to provide high-intensity streams of a cutting agent directed against the interior surface of the tubing or casing to be cut. For example, as disclosed in U.S. Pat. No. 5,320,174 to Terrell et at, a complimentary ring pattern formed of converging cutting ports can be employed to direct a high intensity cutting agent against the inner circumference of the casing or other tubular goods to be cut. Here the ignitor materials can take the form of a multi component accumulation such as steel wool having stainless steel chips intermingled within the steel wool.

Another downhole chemical cutting tool useful for cutting large diameter tubular goods is disclosed in U.S. Pat. No. 5,287,920 to Terrell. Here, the downhole chemical cutting tool is adapted to cut large diameter conduits downhole through the use of a cutting section having a plurality of externally upset cutting heads. These extend outwardly from the cylindrical cutting section to a point where they terminate in outer cutting surfaces having a desired effective diameter slightly smaller than the inner diameter of the tubular goods to be cut. Each of the cutting heads has a central chamber communicating with an interior chamber within the tool and a plurality of cutting ports which extend through the face of the cutting head from the interior chamber therein to the exterior of the cutting head. In a specific embodiment of this patent, the cutting heads are arranged in a spoke like configuration in which an outer disk portion is secured to the spoke by an enlarged threaded connection and the spoke is in turn threadedly secured to the tool body through a second, reduced threaded connection. Ignitor material may be positioned in the interior chamber within the tool located immediately below the section of the tool containing the chemical cutting agent or it may be located in the individual spokes or at both locations.

Yet another chemical cutting tool is disclosed in U.S. Pat. No. 4,494,601 to Pratt et al. Here, a lower part of the cutting head structure is open to well fluid and a piston plug is interposed immediately above the cutting ports. The cutting ports may be closed to the exterior of the well by means of an internal sleeve positioned in the bore of the cutting head immediately in front of the piston. When the tool is fired, the fluid pressure developed sets the anchoring means and forces the piston forward, exposing the port to the cutting fluid flowing into the bore from the chemical section. The tool further comprises means in the cutting section in front of the port to receive the piston upon the application of fluid pressure in the tool to lock the piston in place at a location in front of the cutting port. The locking means may take the form of a reduced section in the cutting tool bore which is adapted to receive a portion of the piston in a swedged relationship.

SUMMARY OF THE INVENTION

In accordance with the present invention there is provided a novel downhole chemical cutting tool which can be employed to sever downhole tubular goods and temporarily support the tubular goods within the well through a load beating hub section of the tool. The chemical cutting tool of the present invention comprises an elongated tool body having a upper head section which is adapted to be connected to a running string such as a string of conventional tubing joints or a string of coiled tubing which is capable of supporting large loads downhole. The tool body further comprises a propellent section which is adapted to contain a pressure generating propellant and a cutting section. A chemical section is interposed in the elongated tool body between the propellant section and the cutting section and contains at least one chamber adapted to contain a chemical cutting agent. The cutting section is adapted to receive the chemical cutting agent and has an outer wall section which contains a plurality of transverse cutting ports. These cutting ports are arranged circumferentially of the cutting section to provide for the discharge of the chemical cutting agent against the interior surface of the casing or the tubular goods to be cut. An anchoring section is provided in the lower portion of the tool body at a location below the cutting section so that suitable means can be attached to the anchoring section to grip the inner surface of the tubular goods below a point in which the cut is to be made.

The tool body further comprises a load bearing hub section which extends longitudinally through the cutting section to the anchoring section. The hub section functions to connect the anchoring section to the upper portion of the tool body in a load bearing relationship. The hub section is capable of sustaining a substantial loads in tension. Preferably, the hub section has a load bearing factor in tension of at least 50,000 pounds. The tool further comprises a plurality of longitudinally extending flow passages which are spaced circumferentially about the hub section. These passageways extend longitudinally along the hub section of the tool body and are in fluid communication with the chemical section so that when the tool is fired a chemical cutting agent can flow from the chemical section through the passageways to the cutting ports. Preferably the flow passages are provided with individual accumulations of ignitor material interposed between the cutting ports and the chemical section, thus providing for pre-ignition of chemical cutting agent as it is dispensed from the cutting ports.

In a preferred embodiment of the invention, the hub section comprises an interior shaft which extends through the cutting head to define an annular chamber between the shaft and the outer wall section into which the chemical cutting agent is dispensed. A dispensing section is interposed between the chemical section and the passageways and provides a plurality of dispensing channels which diverge downwardly and outwardly from the chamber within the chemical section to the longitudinal flow passageways. In one embodiment of the invention, the longitudinal passageways are provided with a plurality of insert segments which extend between the dispensing section and the cutting section. Each insert segment provides a flow passageway. In this embodiment it is preferred that the hub section comprise a plurality of circumferentially spaced upstanding ribs which define corresponding longitudinally extending depressions which receive the insert segments.

In yet another embodiment of the invention, the longitudinally extending flow passageways are located within a firing ring which is disposed about a central shaft portion of the hub section. The longitudinal flow passages in the firing ring open to an annular chamber as described above providing for the flow of chemical cutting agent into the annular chamber and then into the cutting ports. Preferably individual accumulations of ignitor material are disposed within the flow passages of the firing ring. Seal plugs are disposed in the passageways at the bottom there of to provide a shield between the cutting ports and the accumulations of ignitor material.

In a further embodiment of the invention the cutting section comprises a plurality of elongated cutting segments which conform to provide a segmented outer wall containing the transverse cutting ports. The hub section has a star like cross section defining a plurality of wedged shaped longitudinally extending depressions which receive the cutting segments, which are, in turn, generally wedge shaped. Preferably five or more segments are employed so that each segment subtends an angle of substantially less than 90° to provide a relatively shallow travel configuration for the chemical cutting agent as it traverses through each cutting segment.

DETAILED DESCRIPTION OF THE INVENTION

The present invention provides a downhole chemical cutting tool which can be effectively used to sever downhole tubular members while temporarily supporting the severed portion of the tubular member so that it can be lowered to the bottom of the well without causing damage to the section of the well below the cut. This is accomplished in the present invention through the use of a particular cutting head configuration which can be employed in conjunction with a centrally disposed load bearing member of the tool so that cutting fluid flows around the load bearing member and through appropriate exit ports. This is accomplished without sacrificing effective pre-ignition of the cutting agent or distribution of the cutting agent through the cutting ports in a sufficiently uniform manner to effect a clean cut in the severed tubular goods.

Figure 1:
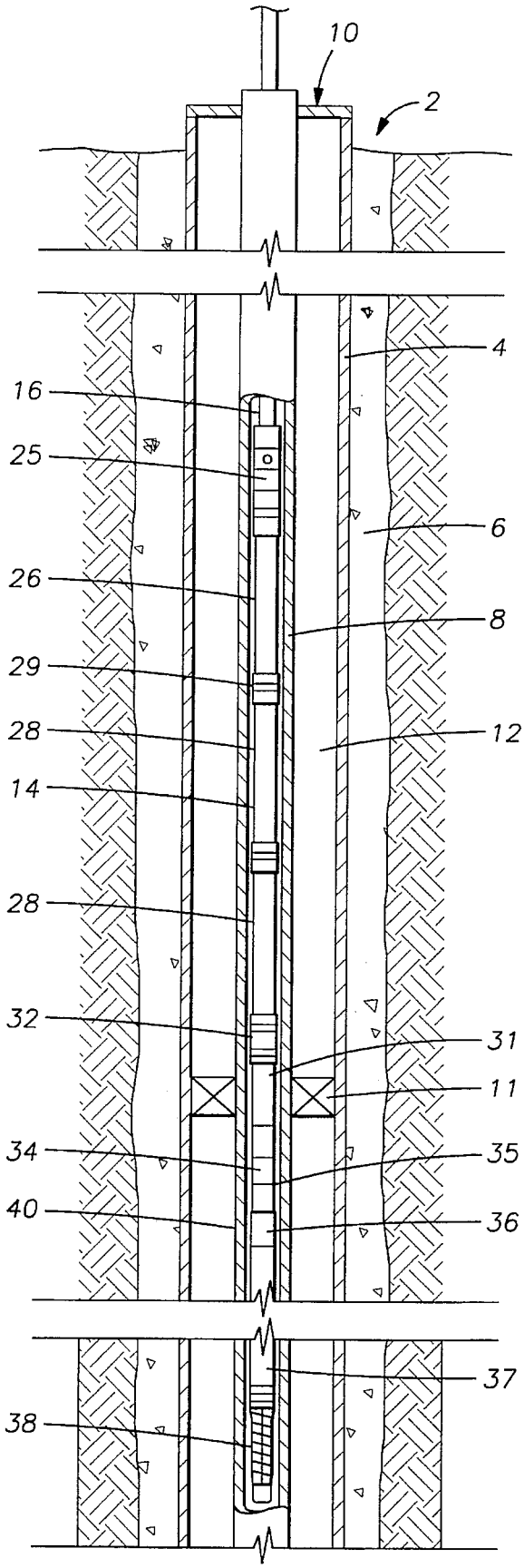
FIG. 1 is an illustration, partly in section, showing a downhole chemical cutter of the present invention positioned within a well.

Turning now to the drawings and referring first to FIG. 1, there is illustrated a chemical cutting tool embodying the present invention disposed within a well extending from the surface of the earth to a suitable subterranean location, e.g., an oil and/or gas producing formation (not shown). More particularly, and as is illustrated in FIG. 1, a well bore 2 is provided with a casing string 4 which is cemented in place by means of a surrounding cement sheath 6. A tubing string 8 is disposed in the well and extends from the well head 10 to a suitable downhole location (not shown). A packer 11 is set between the tubing string and casing at a location above a point at which the tubing string is to be severed. The tubing string and/or the annular space 12 between the tubing and the casing may be filled with high pressure gas and/or a liquid such as oil or water. Alternatively, the tubing string 8 or the annulus 12 may be "empty", i.e., substantially at atmospheric pressure.

As further illustrated in FIG. 1, there is shown a chemical cutting tool 14 which is suspended in the well on a suitable running string 16 such as coiled tubing or the like which is capable of sustaining substantial downhole loads in tension and which can carry load in torque so that the tool can be rotated downhole to anchor the tool as described hereinafter. The chemical cutter 14 connected to the coiled tubing string 16 by means of a head as described below. The coiled tubing string 16 passes by suitable depth indicating means such as a mechanical or electrical counter 18 to a suitable draw works incorporating a coiled tubing reel (not shown). The counter 18 produces a depth signal which is applied to an indicator 22 to give a readout of the depth at which the tool is located. It will, of course, be recognized that the well structure illustrated is exemplary only and that the cutting tool 14 can be employed in numerous other environments. For example, instead of a completed well, the tool can be employed in severing a drill pipe in either a cased or uncased well. In this case, the tubing string 16 shown could be replaced by a string of drill pipe. Also, rather than coiled tubing as a running string, the running string can take the form of conventional stands of rigid tubing, stands of sucker rod pipe or the like, supported from the well head by a conventional work-over rig. Also, where the anchoring system is such that the tool need not be rotated downhole, the chemical cutter can be lowered into the well on a flexible cable of sufficient strength to carry the requisite downhole load after the cutting tool is operated.

The chemical cutter 14 comprises five sections. At the upper end of the tool, there provided is a pressure activated firing head (PAFH) 25, which is sealably connected to the interior of the coiled tubing string 16 in a load bearing relation. The firing head incorporates a fuse which can be activated by the application of suitable pressure through the tubing string 16 and one or more boosters which can be used to ignite the propellant in a propellant section 26 located below the firing head 25. Where coiled tubing or rigid tubing is employed as the running string, a pressure activated firing mechanism will usually be preferred. This can be readily activated by application of a suitable pressure pulse from the surface without the necessity of a complicated mechanisms or telemetry systems. However, any suitable means can be used to fire the chemical cutter once it reaches the downhole location. For example, a "go devil" can be dropped down the tubing string in order to activate a fuse firing mechanism. Alternatively, an electrically activated fuse mechanism could be employed. An electrically activated fuse would be suitable, for example, where the coiled tubing string carries an electrical conductor which might be present for telemetry purposes or the tool is run into the well on a cable which also would normally provide a suitable electrical conductor.

The propellant section 26 provides a source of high pressure gas. For example, the propellant section 26 may take the form of a chamber (or a plurality of chambers as described in one embodiment of the invention below) which contains a propellant, such as a plurality of gun powder pellets, which burns to produce the propellant gases. As described below, in a preferred aspect of the invention, the individual propellant pellets may be employed in conjunction with one or more spacers which avoid the generation of excessive heat within the propellant section which could lead to damage to the cutting tool.

A chemical section 28 is located immediately below the propellant section and is connected to section 26 by means of a transition sub 29. The chemical section contains one or more chemical modules which contain a suitable chemical cutting agent such as bromine trifluoride or other appropriate agent, as described in greater detail later. A dispensing and igniting section 31 is located immediately below the chemical section and is connected thereto by a means of a suitable dispenser transition sub as indicated by reference numeral 32.

The cutting head 34 of the chemical cutting tool is disposed below the dispensing section and is provided with a plurality of cutting ports as indicated by reference numeral 35. An anchoring section 36 is located in the lower portion of the chemical cutting tool below the cutting head 34. As described in greater detail below, the various embodiments of the cutting tool of the present invention are provided with a load bearing hub section (not shown in FIG. 1) which extends longitudinally through the cutting section to the anchoring section 36. The hub section, which as described below preferably has a solid cylindrical cross section having a diameter of about 1" or more, functions to connect the anchoring section 36 to the head section 25 of the tool in a load bearing relationship.

The bottom anchoring section 36 is provided with an anchor 38 which can be employed to secure the chemical cutting tool to the tubing string 8 in a load beating relationship at a location immediately below where the cut is to be made. Any suitable type of anchor may be employed in carrying out the present invention. In the embodiment illustrated schematically in FIG. 1, the anchoring section is equipped with a tubing spear 38 of any suitable type such as those which are well known for use in "fishing tools" and the like for the recovery of downhole tubular goods. While the tubing spear or other anchoring means can be directly connected to the anchoring section 36, it normally will be connected through a piece of pipe such as indicated by reference numeral 37 which is of sufficient length to displace the anchoring mechanism from the cutting ports to guard against damage to the anchoring mechanism. By way of example, the anchor may be connected to the anchoring section through a 10 foot length of tubing. Although shorter or longer displacement intervals can be employed usually it will be preferred that the anchor itself be displaced from the cutting ports by at least 10 feet. The tubing spear can be "set" by downward pressure on the tubing string 16 when the tool is at the desired location and the tubing string 16 then rotated clockwise to cause the spiral flights of the spear to dig into the interior surface of the tubing. Such tubing spears are in themselves well known in the art and a suitable anchor may take the form of a Bowen Releasing Spear, P/N 1348 with 1 13/16 flush joint connection available from Bowen Tools, Houston, Tex.

Alternative anchor systems can be employed depending upon the environment in which the chemical cutting tool is used and the nature of the running string 16. For example, where the chemical cutter is run into the well on a cable or the like, such that the tool can not be rotated by torsional force applied at the surface, the anchor system may take the form of slip mechanisms which can be anchored downhole in response to a signal applied from the surface. For example, a downhole anchor system of the type disclosed in U.S. Pat. No. 5,095,993 to use in downhole wire-line conveyed perforating guns can be adapted for use in the present invention.

The operation of the chemical cutting tool 14 shown in FIG. 1 may be described briefly as follows. The tool is run into the well on the running string 16 to the desired depth at which the tubing 8 is to be severed. The tool is then anchored to the tubing string 8 by means of the anchor 38. Suitable pressure is then developed in the pressure activated firing head by means of workover fluid pumped down the tubing string 16. When the requisite pressure is reached, the fuse is fired within the firing head which in turn ignites the propellant charges within the propellant section 26. As the propellant burns, a high pressure gas is generated and travels downwardly to the chemical section, where it generates sufficient pressure to rupture seal diaphragms (described later) within the chemical section which normally retain the cutting agent in place. The chemical cutting agent is forced into the dispensing section 31 where it comes into contact with an accumulation of preignitor material, such as steel wool or the like, which functions to activate the bromine trifluoride or other chemical cutting agent, bringing it to a temperature which will sever the tubing string 8 at location 40. The preignited cutting agent is then forced into the cutting section where it is dispensed through the cutting ports 35 outwardly against the interior surface of the tubing string. In a short period of time, typically a few seconds or less, the tubing string is severed and the lower section of the tubing string below point 40 is then supported via the chemical cutting tool and running string from the surface. At this point, the severed section of the tubing string can be lowered to the bottom of the well by lowering the running string 16 until the severed section of the tubing comes to rest at the bottom of the well or other support structure, e.g. a downhole packer (not shown) located deeper in the well. The cutting tool can then be released from the severed portion by any suitable means of deactivating the anchor system. For example, in the case of a tubing spear such as described previously which is anchored by clockwise rotation, the tubing string can be rotated in a counterclockwise manner to disengage the anchor from the severed portion of the tubing. The cutting tool can then be withdrawn from the well. If desired, the severed section of the tubing can later be withdrawn from the well through the use of suitable fishing tools in a manner which will be readily understood by those skilled in the art.

For a further description of the general operating conditions and parameters employed in the chemical cutter tool 14, reference may be made to the aforementioned U.S. Pat. Nos. 4,494,601, 5,287,920 and 5,320,174, the entire disclosures of which are incorporated herein by reference.

Figure 2:
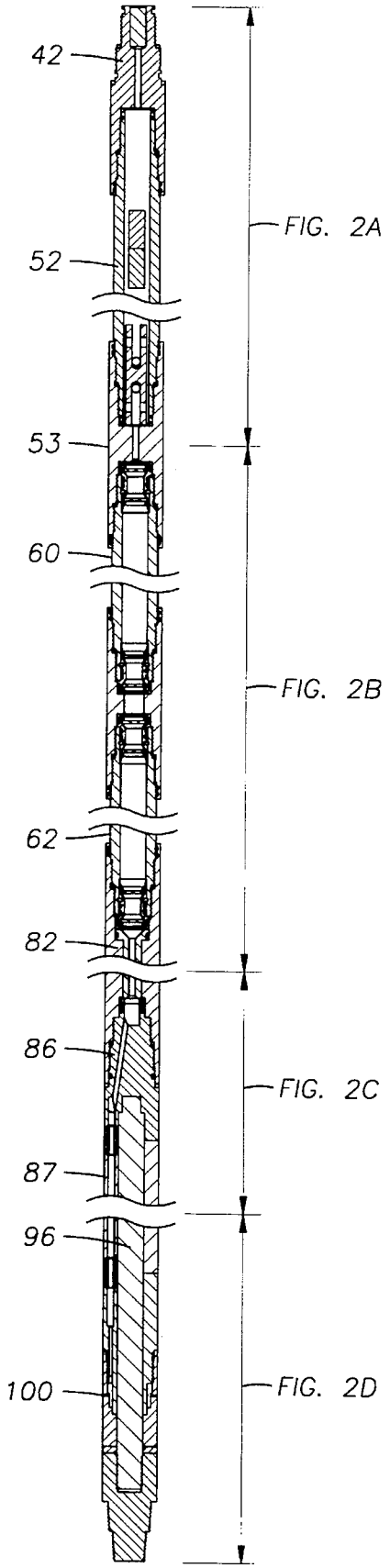
FIG. 2 is a side elevational view, partly in section, illustrating one embodiment of the present invention.

Turning now to FIG. 2 of the drawings, there is illustrated a preferred embodiment of the cutting tool of the present invention in which the cutting ports are formed in a unitary head section and are directed from an annular chamber into which a plurality of longitudinally flow passages extend for the distribution of the chemical cutting agent. The chemical cutting tool of FIG. 2 is shown in detail in FIGS. 2A–2D which generally show in each figure the portions of the cutting tool bracketed by brackets 2A–2D of FIG. 2. As shown in the upper portion of FIG. 2 and in FIG. 2A, a firing adaptor 42 which is adapted to be connected to a pressure activated firing head (not shown in FIG. 2A) contains a booster charge 43. The firing adaptor 42 is adapted to be connected to the pressure activated firing head through a coordinated thread design comprising a reduced diameter threaded male coupling 45 coordinated with an enlarged diameter threaded male coupling 46. The firing adapter is in turn threadedly connected to the propellant section through a coordinated thread design which comprises reduced and enlarged threaded female couplings 47 and 48 corresponding to threaded male couplings 49 and 50 on a propellant tube 52.

As explained in greater detail below, coordinated thread connections of this nature are used at various locations in the chemical cutting tool of the present invention to provide interconnections between tool modules to provide load carrying members capable of sustaining very large downhole loads. In each case, a coordinated thread connection comprises a small diameter threaded connection, e.g. as indicated by connection 47, 49 in FIG. 2A and a relatively large diameter connection as indicated by connection 48, 50 in FIG. 2A. These different diameter threads, which are of the same pitch, provide for increased cross-sectional areas of metal in the mating parts to sustain larger loads than would be carried by conventional threaded couplings of male and female couplings of a single conforming threaded diameter.

Figure 2A:
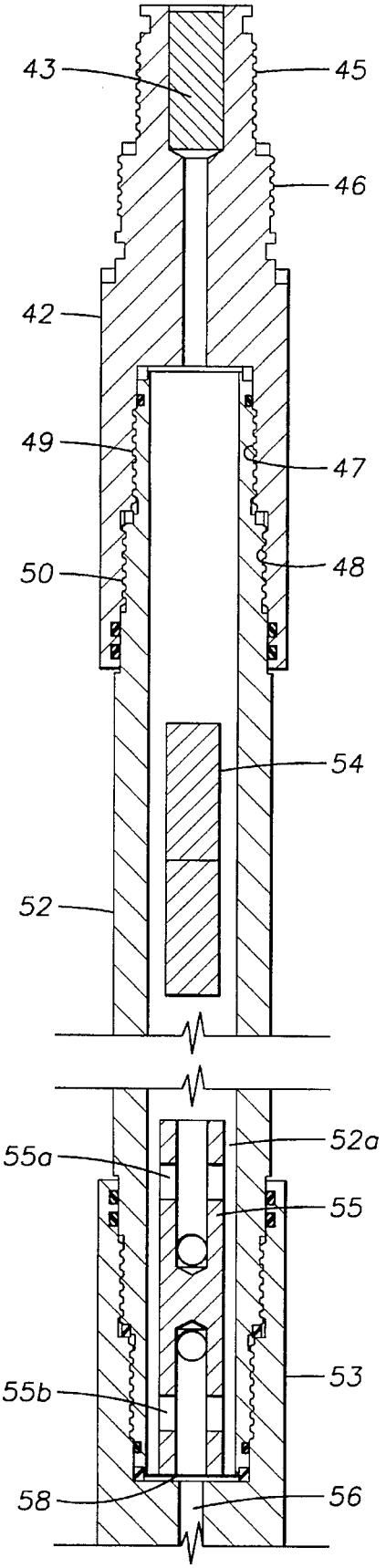
FIGS. 2A, 2B, 2C and 2D are side elevational views, partly in section, showing sequential portions of the chemical cutting tool of FIG. 2.

As further shown FIG. 2A, the propellant tube 52 is connected at its lower end to a transition sub 53 through a coordinated thread connection. Tube 52 contains a plurality of propellant cartridges 54 and in the preferred embodiment illustrated, at least one spacer as indicated by reference numeral 55. The propellant cartridges in the embodiment shown, rest upon the spacer 55 so that the bottommost propellant charge is spaced from the restrictive flow passage 56 leading from the propellant chamber into the chemical section. The spacer 55 may take the form of an inverted tubular cap shape member formed of a mild steel material, e.g. the spacer prevents or at least retard direct impingement of the hot propellant gases on the shoulder 58 of the tool in the vicinity of the restricted passage 56, thus alleviating or at least lessening damage to the tool at this point and below in the chemical section. In the embodiment illustrated, the spacer 55 has a somewhat smaller external diameter than the inner diameter of tube 52 to provide an annular space **52*a*. The hot propellant gases flow into the spacer and thence outwardly through upper ports 55*a*, downwardly through the annulus 52*a* and then inwardly into the spacer through lower ports 55*b* and then into passageway 56**.

In the embodiment illustrated, the chemical section comprises two chemical modules 60 and 62, each containing bromine trifluoride (or other suitable chemical cutting agent) and each sealed at its ends by means of dual diaphragm closure assemblies 64 of the type as disclosed, for example, in U.S. Pat. No. 5,322,118 to Terrell. As illustrated in FIG.

2B, the dual diaphragm assembly located at the bottom of the first chemical module 60 comprises a tubular diaphragm retainer body 66 having a reduced central portion 67 and enlarged end portions 68 and 68*a* which contain cup shaped rupture diaphragms 70 and 71. Each rupture diaphragm has a cylindrical rim section 72 conforming to the inner surface of the diaphragm retainer body 66. By way of example, the rim portion 72 of the upper rupture diaphragm fits into the diaphragm retainer body 66 by an interference fit of perhaps 1–5 mils. The lower diaphragm 71 similarly fits into the lower portion of the tubular seal body. The rim section 72 of each rupture diaphragm 70 and 71 is heliarc welded to the diaphragm retainer 66 to provide the necessary mechanical integrity and fluid seal. The tubular seal body 66 is chamfered on its inner end as indicated by reference numeral 74. The chamfer, which is found on each end of the tubular bodies and preferably has a bevel angle of less than 45°, reduces turbulence of the chemical cutting agent as it leaves the module in which it is retained, thus lessening damage to the tool body at this point. Each of the tubular diaphragm bodies is provided with a retainer lip 75 so that the tubular diaphragm body is held in place by a corresponding shoulder of the transition sub or other threaded module which retains the chemical module in the elongated tool body. Each tubular seal body is also provided with o-ring seals 76.

Figure 2B:
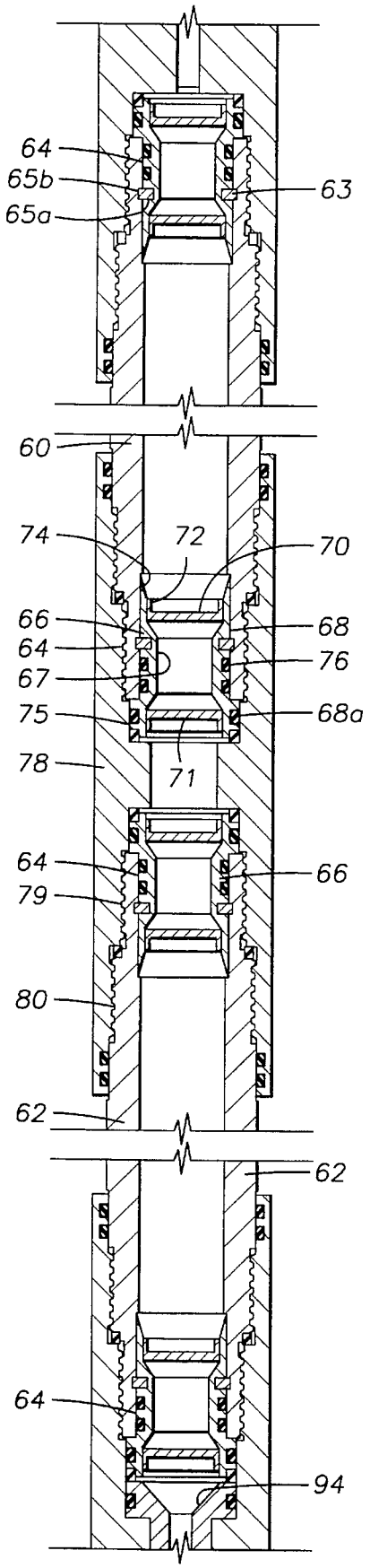

Each of the diaphragm retainers 66 is secured in place within its respective chemical module by means of a snap ring assembly which locks the tubular retainer in place within the chemical module tube. As shown in FIG. 2B, the upper diaphragm closure assembly in the upper end of module 60 comprises a metal snap ring 63 which is depressed within a groove 65*a* formed in the outer surface of the tubular retainer body 66. The retainer body is inserted into the upper end of the module tube 60 and when the proper position is reached, the snap ring 63 expands into a corresponding groove 65*b* on the inner bore of tubular member 60 to lock the retainer assembly in place. This snap ring functions to hold the diaphragm retainer bodies securely in place permitting field assembly of the tool with a plurality of such chemical modules without fear of the retainer bodies being inadvertently dislodged during assembly.

The lower chemical module tube 62 is secured to the upper module tube 60 by means of a transition sub 78 which has upper and lower coordinated thread connections 79 and 80 similar to the threaded connections described above with reference to FIG. 2A. The lower chemical module is similar in all respects to the upper module. Normally, the chemical cutting tool of the present invention will contain two chemical modules although, depending upon the circumstances and the size and nature of the tubular member to be cut, one module may suffice in some cases and in others, more that two modules may be called for.

The chemical cutting agent used to carry out the present invention may be of any suitable type as may be required depending upon the nature of the material in the tubular goods to be cut. The chemical cutting agent normally will take the form of a halogen fluoride, specifically bromine trifluoride, as described previously. Other chemical cutting agents which can be used in the present invention can include nitrogen fluoride and mixtures of nitrogen fluoride and molecular fluorine as described, for example, in U.S. Pat. No. 4,619,318 to Terrell et al. As described there, a preferred form of such cutting agent comprises approximately equal parts of nitrogen, fluoride and fluorine. The gaseous chemical cutting agent may contain nitrogen fluoride in the form of nitrogen trifluoride ($NF_3$) tetrafluorohydrazine ($N_2F_4$) and difluorodiazine ($N_2F_2$) compounds. Nitrogen trifluoride disassociates at elevated temperatures of about 1,100° K.–1,500° K. into the free radical $NF_2$ and fluorine. It also pyrolyses with many of the elements to produce tetrafluorohydrazine and the corresponding fluoride. Tetrafluorohydrazine also disassociates at elevated temperatures in a reversible reaction to form the free radical $NF_2$. Nitrogen is a suitable trifluoride cutting agent since it is a thermodynamically stable gas at the temperatures usually encountered and is available in commercial quantities.

The cutting agent source may also comprise a solid perfluoroammonium salt which decomposes upon heating to produce a gaseous chemical cutting agent containing nitrogen fluoride. Suitable perfluoroammonium salts which may be employed in this regard include $NF_4SbF_6$, $NF_4AsF_6$, $NF_4Sb_2F_{11}$, $NF_4Sb_3F_{16}$, $(NF_4)_2TiF_6$, $(NF_4)SnF_6$, $NF_4SnF_5$, $NF_4BiF_6$, $NF_4BF_4$, $NF_4PF_6$, and $NF_4GeF_5$. These salts, when heated to temperatures on the order of about 300° C. and above, decompose to form $NF_3$ and $F_2$. For a further description of such cutting agents, reference is made to the aforementioned U.S. Pat. No. 4,619,318, the entire disclosure of which is incorporated herein by reference.

Figure 3:
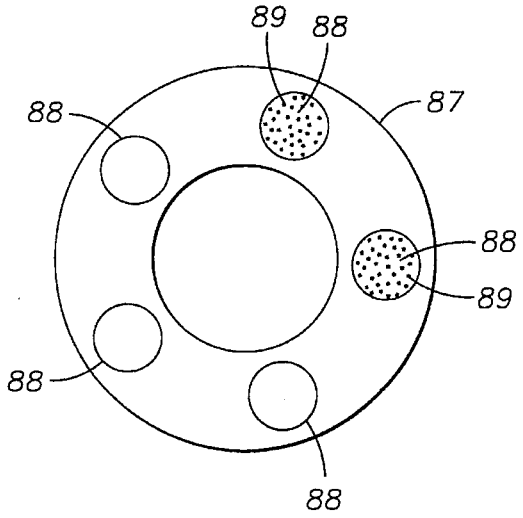
FIG. 3 is a sectional view taken along line 3—3 of FIG. 2*c*.
Figure 2C:
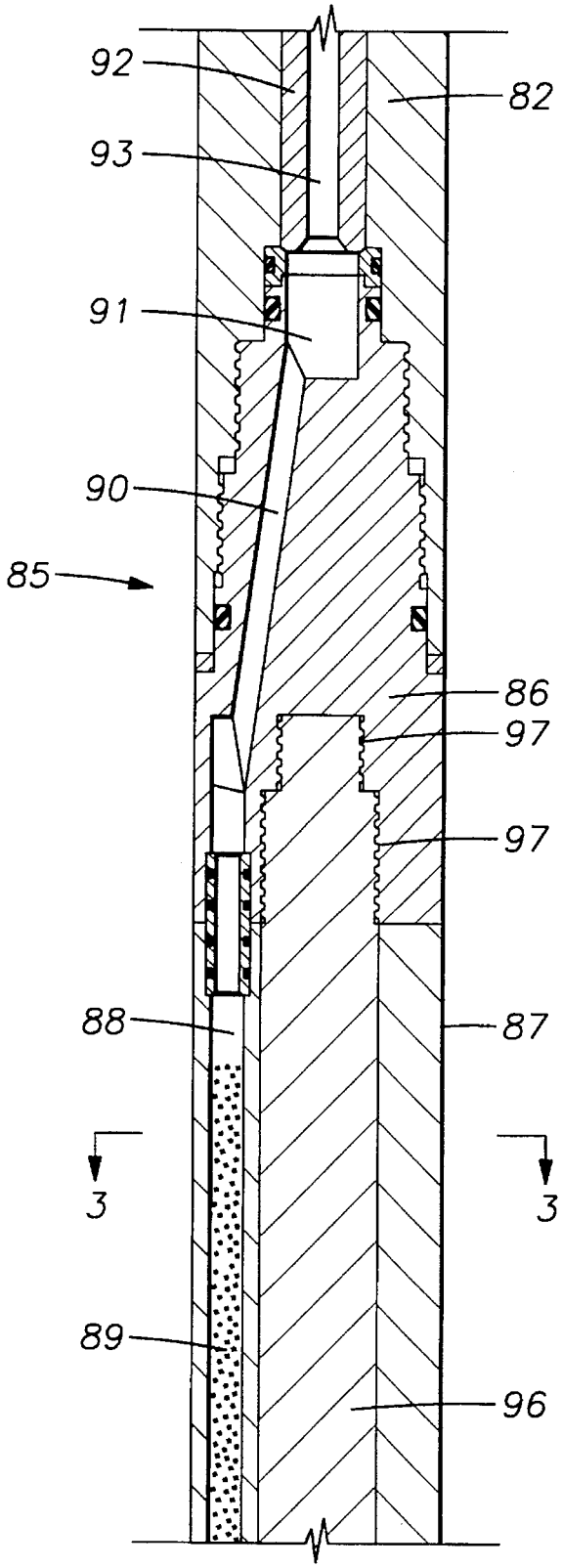

The lower chemical module is secured by means of a coordinated thread transition sub 82 to a dispensing section 85 which includes a dispenser 86 sub and firing ring 87. The firing ring 87 comprises a plurality of elongated passageways or cavities 88 each of which contain an accumulation of ignitor material 89 as shown in FIG. 2*c*. As shown by the sectional view of FIG. 3, the firing ring comprises five flow passages 88 extending into the firing head, although it will be recognized that more or less flow passageways may be employed.

The dispenser sub 86 comprises a plurality of downwardly diverging dispensing passages 90 which extend into a conforming relationship with the flow passages in the firing ring. The diverging passageways 90 open at their upper ends into a common chamber 91 formed in the upper end of the dispenser sub. The chamber 91 opens into the interior of the transition sub 82 which is equipped with a throttling insert 92 having a reduced diameter passageway 93 to regulate the chemical flow. Cutting agent flows from the chemical section through the throttling passageway 93 into the enlarged chamber 91 and thence is evenly distributed through the five diverging passageways of the dispenser sub to the longitudinal passageways of the firing ring 87. The upper portion of the throttling insert 92 is chamfered into the reduced passageway as indicated at 94 in order to lessen turbulence and cavitation as the cutting agent flows into the reduced passageway 93, thus lessening the likelihood of tool damage.

Each of the five passageways 88 is provided with ignitor material 89. A solid hub shaft 96 is threadedly secured into the lower portion of the dispenser sub 86 by means of a coordinated thread connection 97. The firing ring 87 is slidably mounted on the hub shaft 96. A head assembly 98 made up of a modulating head 98 and a cutting head 98B with radially divergent cutting ports 100 is also slidably mounted on the shaft 96. A head 99 is threadedly secured to the firing ring segment. Elongated tubular interconnects 101 having O-ring insert seals 102 are slidably disposed in the mating portions of the diverging dispensing passages and the passages in the firing ring 87 and in the head assembly 98.

Any suitable ignitor material can be used in carrying out the invention. The ignitor material may take the form of an "ignitor hair" such as steel wool or other similar metal having an intermeshing filamentary structure. Steel wool, or steel wool mixed with an oil or another hydrocarbon, has conventionally been used as an ignitor material in chemical cutting applications and ignitor hair thus formulated can be used in the present invention. A suitable ignitor material for use in the invention involves an ignitor hair composite of the type disclosed in the aforementioned U.S. Pat. No. 5,320,174 to Terrell et at. that raises the exit temperature of the cutting fluid to a value higher than that achieved either by steel wool itself or mixed with hydrocarbons. Second metal components which may be used to raise the temperature substantially include chips, powders or shavings of metals such as chromium, nickel, tantalum, titanium. Shavings from the same material as the material to be cut may be either mixed with the steel wool to form a composite ignitor.

In some cases, the ignitor hair need not contain iron but can be formulated of a predominantly non-ferrous material. For example, stainless steel shavings and non-ferrous powders, chips or filings can be used without the presence of steel wool, but mixed with oil or a similar organic material to effect initiation of the ignitor material. Various other materials which can be employed depending upon the nature of the material being cut can include steel wool plus stainless steel or steel wool plus shavings of nickel and chromium, tantalum and titanium. Usually, such mixtures will include grease, oil or other organic starter material.

Where the tubular goods to be cut are formed of high nickel chromium stainless steel or other similar material, a two-component ignitor hair can be used to facilitate pre-ignition of the cutting agent to the desired cutting temperature. The second metal component can be characterized as being more corrosion resistant than the first component due to the alloy mixtures which normally will be encountered in the second component. The second metal component can be tailored to the particular tubular goods to be cut and this can be most readily accomplished by simply forming shavings from an article formed of the same alloy as that forming the tubular goods which are to be cut in the well. Preferably, the shavings also are of a filamentary nature which is integrated throughout the steel wool or other first metal component. Alternatively, chips or discrete particles such as stainless steel chips can be incorporated into the steel wool or other first metal component.

Figure 2D:
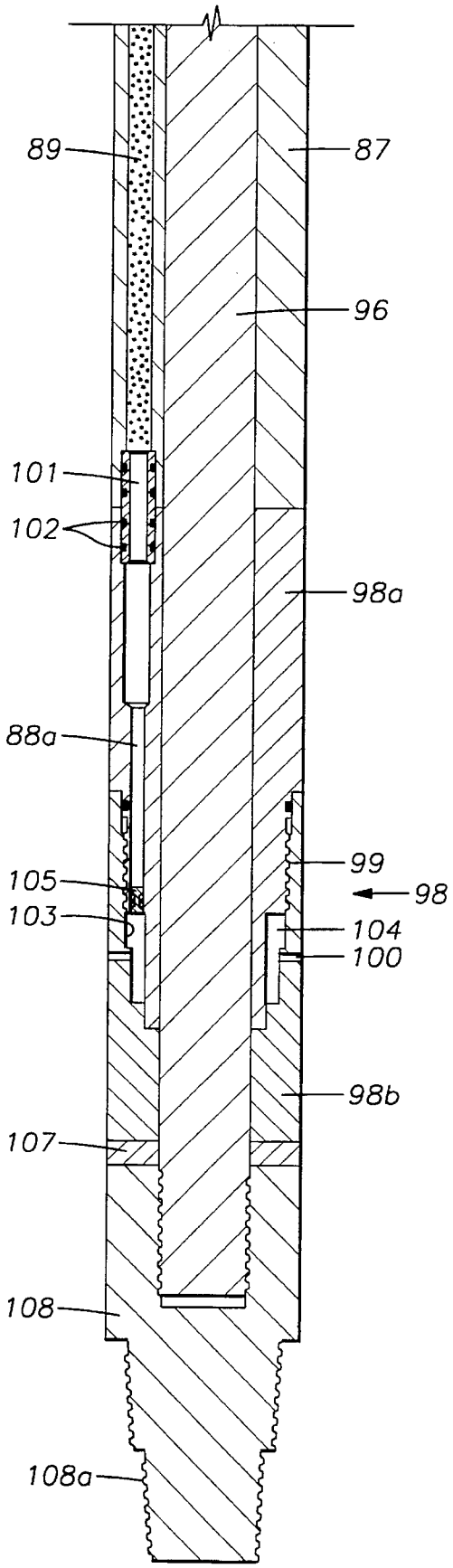

As best shown in FIG. 2D, the upper end of the cutting head 98*b* extending below the threaded connection 99 is radially displaced from a recessed inner portion 103 of the lower segment of the modulating head 98*a* to provide an annular passageway 104 into which the longitudinally extending flow passages 88*a* extend. Each of the flow passageways is fitted at its bottom with a seal plug 105 which closes off the bottom end of the flow passage as it opens into the annular chamber 104. To the extent that well fluid or other debris might enter the annular chamber through the cutting ports as the tool is being lowered into the well, the seal plugs 105 prevent such debris from getting up into a flow passage where it might conceivably plug the passage and prevent the even distribution of cutting agent through the several passageways. When the chemical cutting agent is fired, the cutting fluid flow from the chemical modules flows into the diverging dispensing passageways and thence into the elongated firing ring passageways 88 which contain steel wool 89 or other suitable ignitor material. The seal plugs 105 closing the bottoms of the passageways are dispensed ahead of the cutting fluid into the bottom of the annular chamber below the cutting ports.

Figure 4:
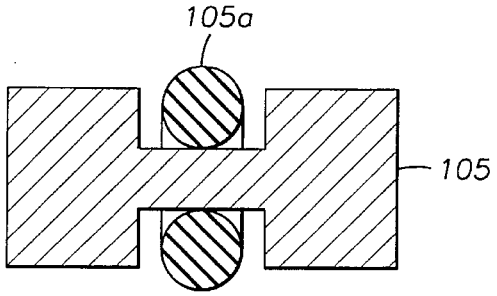
FIG. 4 is a sectional view of a piston plug employed in the present invention.

The seal plugs 95 in the passageway are identical and a plug is shown in an enlarged sectional view in FIG. 4. As shown there, the seal plug 105 is a solid cylinder having a small O-ring 105*a* secured within an intermediate circumferential groove.

The firing ring and cutting head segments are slidably disposed upon the central hub shaft 96 and held in place there by a retaining ring 107 threadedly secured on the lower portion of the hub shaft as shown in FIG. 2D. As noted previously, the hub shaft is preferably a solid member in order that it can sustain the load on tension imposed upon the cutting tool by the loading of the tubular goods in the well after the cut is made. The shaft and the remainder of the tool is made of suitable non-corrosive material such as 17-4 stainless steel. Where the hub shaft is 1" diameter 17-4 heat treated to condition H900 is capable of carrying a load in tension in excess of 125,000 lbs. An anchor sub 108 is threadedly secured to the hub shaft 96 immediately below the ring in FIG. 2D. The anchor sub has a threaded nipple 108*a* which provides a means of securing the tool to a suitable anchor (not shown in FIG. 2D).

Returning to FIGS. 2C and 2D, it will be noted that the flow passages within the firing ring 87 and modulating head 98*a* are progressively decreased in dimension from the upper portion of these passageways to the lower portion 88*a* which enters into the annular chamber 104. By way of example, the upper portion of a passageway which contains the steel wool may have a diameter of about ¼" which is progressively decreased to a diameter of about ⅛" near the bottom of the flow passage 88*a* where it enters the annular chamber 104 of the cutting head. This configuration provides the steel wool 89 maintained in the firing ring 87 until it is consumed during the initial phase of the cutting cycle.

FIGS. 5, 6, 7 and 8 illustrate a modified form of cutting tool in which, in lieu of a firing ring 87 such as shown in FIG. 2C, there are provided a plurality of insert segments 112 interposed between a modified dispensing section 86*a* and the head assembly 98 of the tool. Here, a hub shaft 108 is threaded into a female coupling of the dispenser sub similarly as in the embodiment of FIG. 2. However, in this embodiment of the invention, the upper section of a the hub shaft 108 (corresponds generally to hub shaft 96) is enlarged and provided with longitudinal recesses 109 between ribs 110 to accommodate a plurality individual cylindrical insert segments 112. The segments 112 slidably connect between the dispensing sub 86*a* to the head assembly 98. The firing head assembly 98 can be identical to the firing head assembly 98 shown in FIG. 2.

Figure 5:
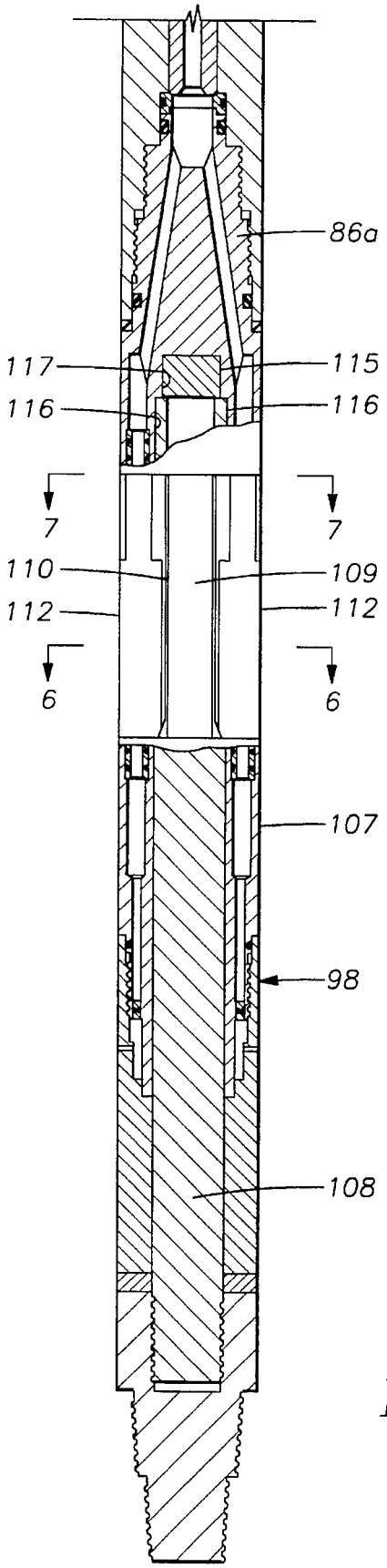
FIG. 5 is a side elevational view, partly in section and with parts omitted, illustrating another embodiment of the present invention.

FIG. 5 is a side elevation partly in section and with parts broken away of the lower portion of this embodiment of the invention assembled. As illustrated, the cylindrical segments 112 when in place prevent relative rotation of the head assembly 98 and the dispenser sub 86*a* relative to each other and relative to the load bearing hub shaft 108. In FIG. 5, one of the five segments 112 is omitted to better show the longitudinal groove-rib structure of the upper hub section. The ignitor hair 89 is shown in the required position in the passageway 124 of one of the insert segments 112.

Figure 6:
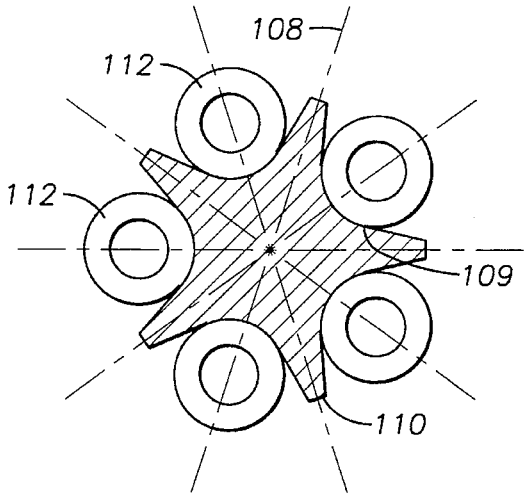
FIG. 6 is a cross-sectional view taken along line 6—6 of FIG. 5.

In this embodiment of the invention, the enlarged upper portion of the hub 108 with its plurality of elongated depressions 109 and ribs 110 provides a cross section as shown in FIG. 6. The hub section 108 is provided with coordinated threads at its upper end and is threadedly secured into an enlarged conforming threaded section of the dispensing sub 86*a*. Thus, as shown in FIGS. 5 and 7, the shaft section with its elongated grooves is secured to the dispensing sub 86*a* by means of a coordinated thread assembly comprising the outer large diameter threads 114 on the ribs 110 and reduced diameter threads 115 on the shaft which extend into conforming female joints 116 and 117 of the dispensing sub 86*a*.

Figure 7:
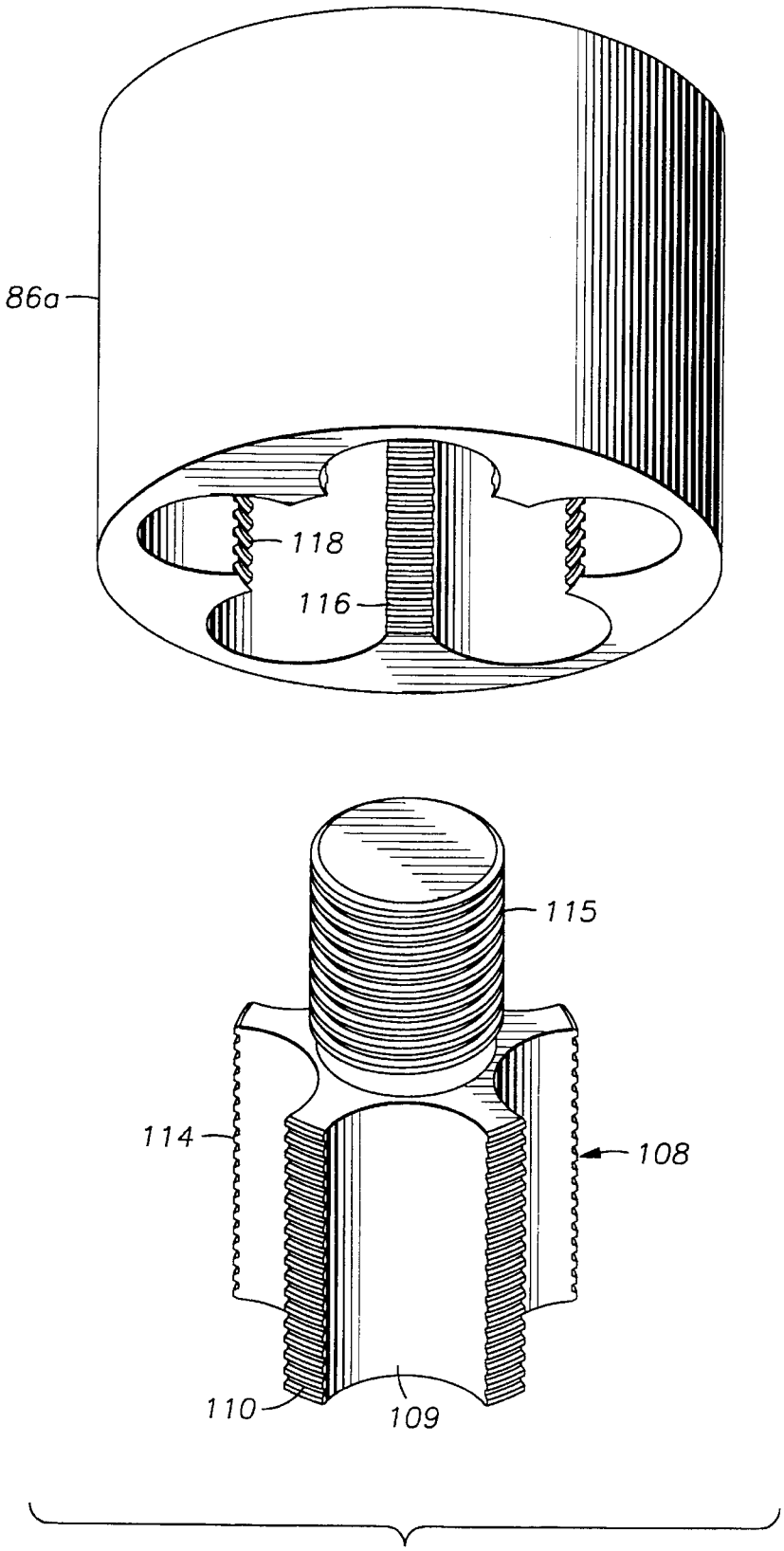
FIG. 7 is a perspective view of a component of the well tool of the embodiment of FIG. 5.

This is best shown in FIG. 7 which is a perspective view with parts exploded showing the bottom of dispensing sub

86*a* and the upper end of the hub 108 without the segments 112 in place. The outer coordinated female threaded portion has semi-circular depressions 118 in the outer threaded joint 116 adapted to receive the tubular segments 112 (not shown). The internally threaded joint 117 shown in FIG. 5 is adapted to receive the threaded shaft 115 of the hub shaft 108.

Figure 8:
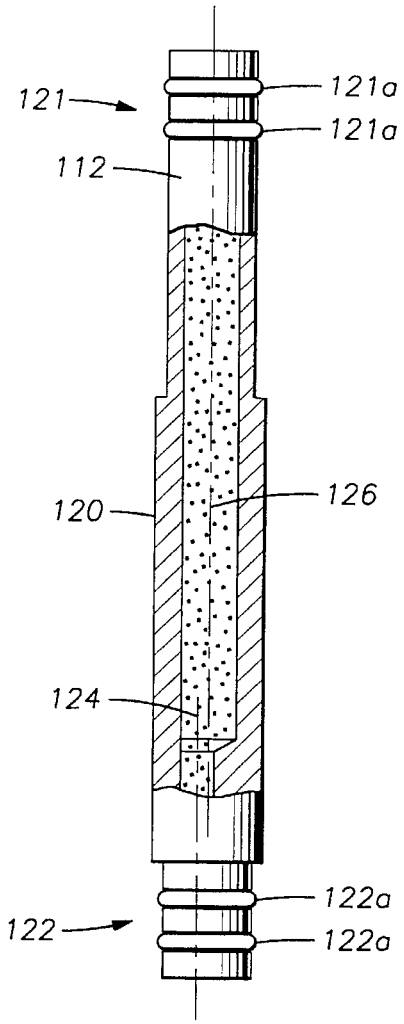
FIG. 8 is a side elevational view, partly in section, showing the details of another component of the embodiment of FIG. 5.

FIG. 8 is a side elevation partly in section of a cylindrical insert segment 112 which extend between the dispensing sub 86*a* and the head assembly 98 when the tool is assembled. As illustrated, each of the cylindrical segments 112 has an outer enlarged intermediate section 120 conforming to the corresponding depressions 109 in the enlarged hub section and reduced end sections 121 and 122, each containing double O-ring seals 121*a* and 122*a* and adapted to fit into the head assembly 98 and the dispenser sub 86*a*. As shown in FIG. 8, the passageways 124 provided in the segment 112, like the corresponding passageways in the embodiment of FIG. 2, progressively decrease in cross-sectional area. The upper enlarged portion of the passageway contain an accumulation of ignitor hair 126, as illustrated.

Figure 9:
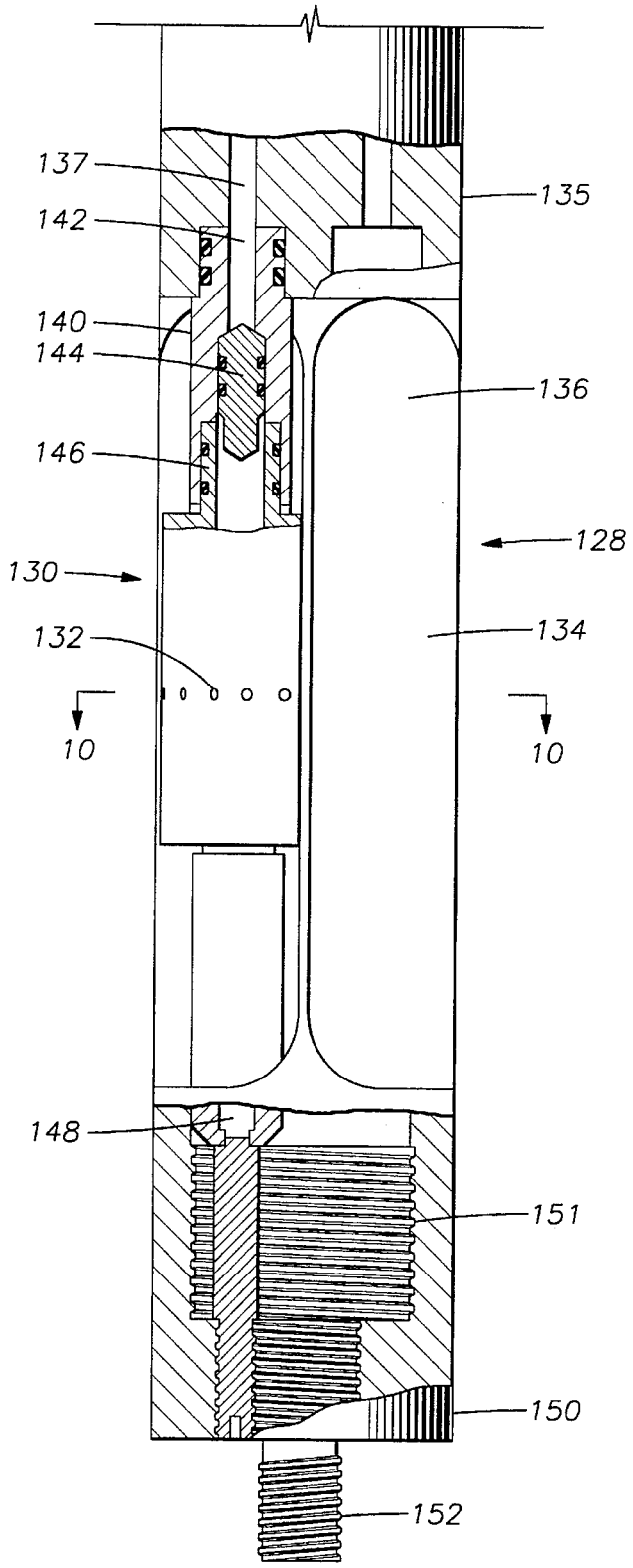
FIG. 9 is a side elevational view, partly in section, of yet another embodiment of the present invention.
Figure 10:
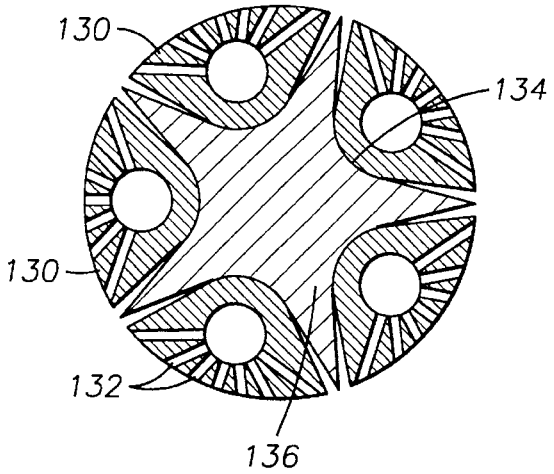
FIG. 10 is a sectional view taken along lines 10—10 of FIG. 9.

A further embodiment of the invention is illustrated in FIG. 9 which is a longitudinal view, partly in section and with parts broken away, showing an alternative form of cutting head 128. The remainder of the tool comprising the components above the dispensing sub is the same as described above. In this embodiment of the invention, the cutting section comprises a plurality of elongated cutting segments 130 which (one of which is omitted from FIG. 9) and which are wedge or pie-shaped in cross section and which conform to provide a segmented outer wall containing cutting ports 132. A central hub section is generally star-shaped in cross-section to provide elongated depressions forming receptacles 134 adapted to contain the cutting head segments 130. More specifically, a dispensing sub 135 (corresponding generally to sub 86*a* in FIG. 5) terminates in an integrally formed hub section 136 which has a star-like cross-section as shown in FIG. 10 defining the plurality of longitudinally extending depressions 134 which receive the elongated cutting segments 130. As shown in FIG. 9, a plurality of passageways 137 are provided in the dispensing sub 135. Inserted into each passageway are individual ignitor subs 140, each of which contains in an upper portion of the passageway 142 thereof, a piston plug 144 which is similar to that described above with reference to FIG. 4. Ignitor hair is located in passage 142 above plug 144. The pie-shaped cutting segments 130, five in number in the embodiment illustrated, are each provided with an upper nipple 146 fitted with double O-rings 146*a* which fit into the piston plug segment. The lower portion of each segment 130 terminates in a cylindrical extension 148 which fits into a bull nose sub 150 which is threadedly secured to the hub section by threaded coordination joint 151 as described previously. The sub 150 is provided with a threaded nipple 152 adapted for securing a suitable anchor system.

Figure 11:
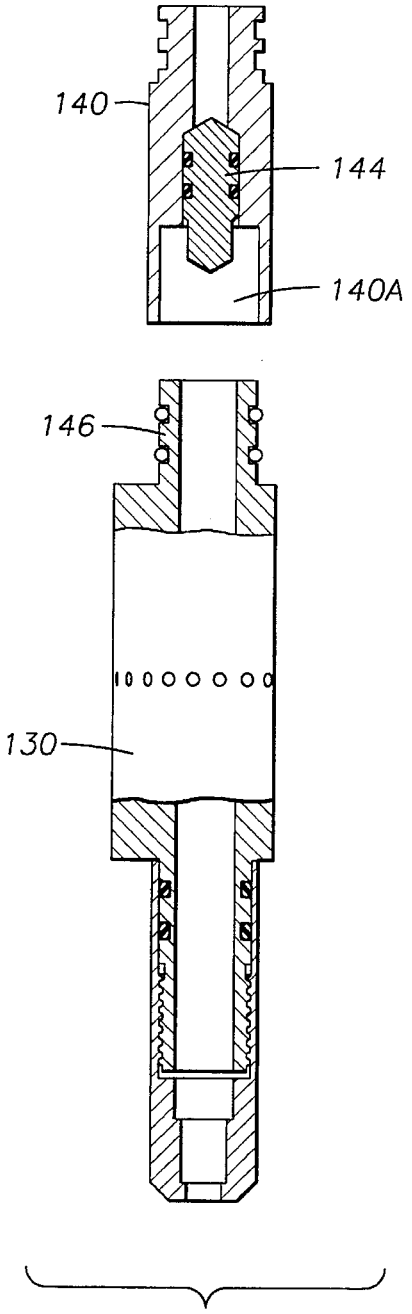
FIG. 11 is an exploded side elevational view with parts in section of components of the embodiment of FIG. 9.

An individual cutting head segment 130 is shown in FIG. 11 in side elevation with parts in section and with the associated sub 140 shown in an exploded view. The upper nipple 146 fits into the bore 140A of the piston plug segment which is fitted with the piston plug 144 at the upper end thereof. The lower extension 148 of segment 130 is likewise provided with double o-rings and fits into the corresponding passageway in the nose sub 150 shown in FIG. 9.

The embodiment of FIGS. 9 through 11 is advantageous where it is desired to cut tubular goods under circumstances in which an unusually high downhole load is to be supported by the hub shaft. For the same size tool having an outer diameter of about 2⅛ inches, the hubshaft having the cross-sectional configuration as shown, for example, in FIG. 10, can carry a load of about 20–25% more than the hubshaft of the embodiment of FIG. 2.

Figure 12:
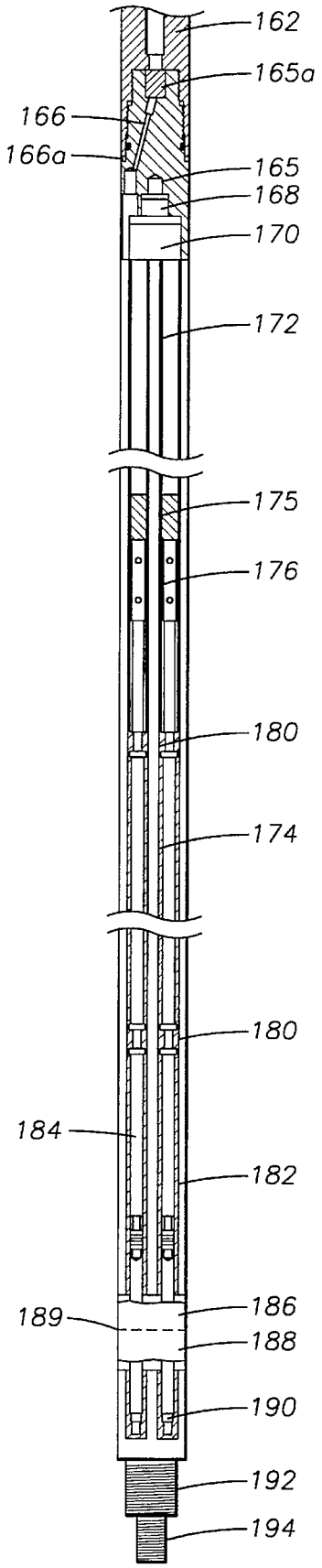
FIG. 12 is a side elevational view, partly in section, showing the details of yet another embodiment of the invention.

FIG. 12 illustrates yet a further embodiment of the invention which is somewhat similar to that of the embodiment of FIGS. 9–11, but which incorporates individual power units and chemical modules rather than common propellant and chemical sections which are connected to a firing adapter which in turn leads to the cutting head segments. In the embodiment of FIG. 12, a firing adapter 165 (corresponding generally to the firing adapter 42 of FIG. 2A), is connected to a pressure activated firing head 162. Firing adapter 165 contains a power unit or booster charge 165*a* (corresponding to power unit 43 of FIG. 2D) and is provided with a plurality of passageways 166 each containing strings of propellant 166*a*. Firing adapter 165 terminates in a female coordinated thread connection 168 which is secured to a hub section 170. Hub section 170 has a star-shaped cross section, corresponding generally to that of the type shown in FIG. 10 above, which is adapted to receive individual power sleeves 172 and chemical modules 174. The power sleeves 172 contain propellant charges 175 which rest upon spacers 176 within the tubular bores of the power sleeves. The chemical modules 174 are closed at their upper and lower ends by diaphragms sleeves 180 which may be of the same type as described previously with respect to FIG. 2B although of substantially smaller dimensions. The ignitor subs 182, each of which contain individuals accumulations of ignitor hair in their passageways 184, are in fluid communication with firing head segments 186 which correspond to those shown above in FIG. 11. Each of firing segments 186 has a pie-shaped cutting head segment 188 with cutting ports 189 conforming generally to those in FIG. 10 above and terminating in lower nipples 190 which extend into a bull nose sub 192. Sub 192 is fitted with a threaded coupling 194 for connection to a suitable anchoring mechanism, as described above.

The embodiment of FIG. 12 operates similarly as the embodiments described previously and results in simultaneous emission of chemical cutting agent through the segmented sleeves notwithstanding the parallel configuration of the power sleeves and chemical modules. In operation, when the pressure activated firing head is fired, it ignites the booster charge 165*a* in the firing unit 165 and in turn, ignites the individual strings of propellant within the diverging passageways 166 of the firing adapter 165. The parallel individual power units and chemical sections function similarly as their unitary counterparts described above. It will be recognized that the number of passageways 166, individual power sleeves 172 and individual chemical modules 174 will correspond to the number of firing segments 186. The same criteria in respect to the cutting segments of the embodiment of FIG. 9 apply here also in that each segment 186 preferably subtends an angle of less than 90°. Thus, where the cutting comprises five firing head segments 186, there will be corresponding sets of five chemical units and five power units with corresponding sets of five propellant strings 166*a*. As noted above, by employing the firing adapter with the divergent passageways and strings of propellants as shown in FIG. 12, the five sets of tool components fire simultaneously with simultaneous expulsion of cutting agent from the cutting ports 189.

Having described specific embodiments of the present invention, it will be understood that modifications thereof may be suggested to those skilled in the art, and it is intended to cover all such modifications as fall within the scope of the appended claims.

I claim:

1. In a downhole chemical cutting tool having an elongated tool body adapted to be inserted into a conduit and positioned at a downhole location thereof for effecting a cutting action in said conduit, the combination comprising:

a) a head section in said tool body adapted to be connected to a running string;

b) a propellant section in said tool body adapted to contain a pressure generating propellant.

c) a chemical section in said elongated tool body interposed between said propellant section and the hereinafter recited cutting section and having at least one chamber adapted to contain a chemical cutting agent;

d) a cutting section in said tool body adapted to receive a chemical cutting agent from said chemical section and having an outer wall section containing a plurality of transverse cutting ports arranged circumferentially of said cutting section therein for the discharge of a chemical cutting agent from said cutting section;

e) an anchoring section disposed in the lower portion of elongated tool body below said cutting section;

f) a load bearing hub section in said tool body extending longitudinally through said cutting section to said anchoring section and connecting said anchoring section to the upper portion of said tool body including said head section in a load bearing relationship;

g) means providing a plurality of longitudinally extended flow passages spaced circumferentially about and extending longitudinally along said hub section of said elongated tool body and in fluid communication with said chemical section to provide for the flow of chemical cutting agent from said chemical section to said cutting ports.

2. The combination of claim 1, further comprising a plurality of individual accumulations of ignitor material interposed in said flow passageways between said cutting ports and said chemical section to provide for the preignition of chemical cutting agent prior to being disposed from said chemical cutting ports.

3. The combination of claim 1, wherein said hub section has a load beating factor in tension of at least 50,000 lbs.

4. The combination of claim 1, further comprising a plurality of seal plugs disposed in said passageways and interposed between said cutting ports and the bottom of said passageways.

5. The combination of claim 1, wherein said cutting ports extend into fluid communication with an interior chamber disposed within said cutting section.

6. The combination of claim 5, wherein said longitudinal flow passages open into the interior chamber of said cutting section.

7. The combination of claim 6, wherein said hub section comprises an interior shaft extending axially through said cutting head and said interior chamber is an annular chamber defined by said shaft and said outer wall section.

8. The combination of claim 7, further comprising a dispensing section interposed between said chemical section and said passageways and providing a plurality of dispensing channels extending from said chemical chamber to said passageways.

9. The combination of claim 8, wherein said dispensing channels diverge downwardly and outwardly from said chemical section chamber to said longitudinal flow passages and further comprising a plurality of insert segments extending between said dispensing section and said cutting section to provide a portion of said flow passageways.

10. The combination of claim 9, wherein said insert segments contain individual accumulations of ignitor material.

11. The combination of claim 9, wherein a portion of said hub section co-extensive with at least a portion said insert segments has a plurality of upstanding splines defining a plurality of longitudinally extending depressions which receive said insert segments.

12. The combination of claim 1, wherein said chemical section comprises a removable module which is interconnected in said tool body by at least one coordinated thread joint having a first larger diameter threaded section and a second smaller threaded section of a diameter less than the diameter of said first threaded section.

13. The combination of claim 1, wherein said propellant section comprises a removal module which is interconnected in said tool body by at least one coordinated thread joint having a first larger diameter threaded section and a second smaller threaded section of a diameter less than the diameter of said first threaded section.

14. The combination of claim 1, further comprising a plurality of chambers in said chemical section conforming to a plurality of said longitudinally extending flow passages.

15. The combination of claim 14, further comprising an ignitor section interposed between said chemical section chambers and said flow passageways and containing individual accumulations of ignitor material interposed between said chemical section chambers and said flow passages.

16. The combination of claim 15, wherein said propellant section comprises a plurality of propellant chambers adapted to contain a plurality of individual propellant charges conforming to said chemical chambers.

17. The combination of claim 16, further comprising a firing adaptor to contain a power unit central firing dispenser and a firing dispensing section in said tool body comprising a plurality of diverging propellant chambers interposed between said central firing dispenser and said propellant chambers.

18. The combination of claim 1, wherein said cutting section comprises a plurality of elongated cutting segments which conform to provide a segmented outer wall containing said transverse cutting ports.

19. The combination of claim 18, wherein said hub section has a star-like cross section defining plurality of longitudinally extending depressions which receive said elongated cutting segments.

20. The combination of claim 19, wherein each of said cutting segments subtends an angle of no more than 90°.

21. In a downhole chemical cutting tool having an elongated tool body adapted to be inserted into a conduit and positioned at a downhole location thereof for effecting a cutting action in said conduit, the combination comprising:

a) a head section in said tool body adapted to be connected to a running string;

b) a propellant section in said tool body adapted to contain a pressure generating propellant;

c) a chemical section in said elongated tool body interposed between said propellant section and the hereinafter recited cutting section and having a chamber adapted to contain a chemical cutting agent;

d) a cutting section in said tool body adapted to receive a chemical cutting agent from said chemical section and having an outer wall section containing a plurality of transverse cutting ports arranged circumferentially in said cutting section therein for the discharge of said chemical cutting agent from said cutting section;

e) an anchoring section disposed in the lower portion of elongated tool body below said cutting section;

f) a load bearing hub section in said tool body extending longitudinally through said cutting section to said anchoring section and connecting said anchoring section to the upper portion of said tool body including said head section in a load bearing relationship and in the portion of said cutting section co-extensive with said wall section containing said cutting ports, having a reduced cross section spaced from the interior surface of said wall section to provide an annular chamber within said cutting section into which said cutting ports extend;

g) a firing ring disposed about a portion of said hub section interposed between said chemical section and said cutting section and comprising a plurality of longitudinally extended flow passages spaced circumferentially about and extending longitudinally along said hub section of said elongated tool body and in fluid communication with said chemical section to provide for the flow of chemical cutting agent from said chemical section chamber to said annular chamber; and h) a dispensing section interposed between said firing ring and said chemical section and having a plurality of diverging dispensing passages extending from said chemical section chamber to said longitudinally extending flow passages to provide for the flow of chemical cutting agent from said chemical section to said longitudinal flow passages.

22. The combination of claim 21, further comprising a plurality of individual accumulations of ignitor material interposed in said flow passageways between said cutting ports and said dispensing section to provide for the preignition of chemical cutting agent prior to being disposed from said chemical cutting ports.

23. The combination of claim 22, further comprising a plurality of seal plugs disposed in said passageways and interposed between said cutting ports and the bottom of said passageways.

24. The combination of claim 21, wherein said chemical section comprises a removable module which is interconnected in said tool body by at least one coordinated thread joint having a first larger diameter threaded section and a second smaller threaded section of a diameter less than the diameter of said first threaded section.

25. The combination of claim 24, wherein said dispensing section comprises a removal module which is interconnected in said tool body by at least one coordinated thread joint having a first larger diameter threaded section and a second smaller threaded section of a diameter less than the diameter of said first threaded section and further comprising a transition sub having opposed threaded boxes interconnecting said chemical section and said dispensing section.

26. The combination of claim 25, wherein said hub section comprises a shaft extended through said firing ring to provide said annular chamber and wherein said shaft is secured to said dispensing section by a coordinated thread joint having a first larger diameter section and a second smaller diameter threaded section with a diameter less than the diameter of said first threaded section secured into a corresponding threaded box joint of said dispensing section.

27. The combination of claim 26, wherein said firing ring is slidably disposed on said shaft and further comprises tubular inserts extending from said dispensing section into at least a portion of said longitudinal flow passages of said firing ring to prevent relative rotation of said firing ring relative to said dispensing section.

28. The combination of claim 27, wherein said shaft of said hub section has a load bearing factor in tension of at least 50,000 lbs.

* * * * *